US011215125B2

(12) United States Patent
Kim et al.

(10) Patent No.: US 11,215,125 B2
(45) Date of Patent: Jan. 4, 2022

(54) ELECTRONIC THROTTLE VALVE APPARATUS

(71) Applicant: HYUNDAI KEFICO CORPORATION, Gunpo-si (KR)

(72) Inventors: Bo Kyeong Kim, Daegu (KR); Jin Kwan Kim, Uiwang-si (KR); Joon Ho Yang, Anyang-si (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 43 days.

(21) Appl. No.: 16/545,364

(22) Filed: Aug. 20, 2019

(65) Prior Publication Data

US 2020/0063663 A1 Feb. 27, 2020

(30) Foreign Application Priority Data

Aug. 23, 2018 (KR) ..... 10-2018-0098347

(51) Int. Cl.
*F02D 9/10* (2006.01)
*F02M 35/10* (2006.01)
*F02D 9/02* (2006.01)

(52) U.S. Cl.
CPC ..... *F02D 9/1035* (2013.01); *F02D 9/02* (2013.01); *F02M 35/10006* (2013.01); *F02D 2009/0294* (2013.01)

(58) Field of Classification Search
CPC ..... F02D 11/10; F02D 2009/0228; F02D 2009/0294; F02D 2200/0406; F02D 9/02; F02D 9/1035; F02M 35/10006
(Continued)

(56) References Cited

U.S. PATENT DOCUMENTS 5,711,271 A * 1/1998 Schlagmueller ..... F02D 9/10 123/339.24
6,039,029 A * 3/2000 Nagasaka ..... F02D 9/101 123/442
(Continued)

FOREIGN PATENT DOCUMENTS

JP 2592642 Y2 3/1999
JP 2005-231853 * 9/2005
(Continued)

*Primary Examiner* — Phutthiwat Wongwian
*Assistant Examiner* — Diem T Tran
(74) *Attorney, Agent, or Firm* — Mintz Levin Cohn Ferris Glovsky and Popeo, P.C.; Peter F. Corless

(57) ABSTRACT

An electronic throttle valve apparatus including a suction pressure sensor provided on the upstream of a throttle valve to measure pressure of an intake air that flows into the throttle valve is provided. The electronic throttle valve apparatus includes a throttle housing having one side installed in an intake manifold of an engine. Within an inside of the throttle housing, a throttle valve is rotatably provided. The electronic throttle valve apparatus further includes an air tube fastened to the other side of the throttle housing and fastened to an intake flow line, and a suction pressure sensor provided in the air tube and configured to measure pressure of an intake air that flows through the intake flow line. Accordingly, the suction pressure sensor is provided in the air tube that is fastened to the throttle housing, and thus the pressure of the intake air that flows into the throttle valve is easily measured.

8 Claims, 12 Drawing Sheets

(58) Field of Classification Search
USPC ..... 123/336, 337, 399; 73/114.31, 114.32, 73/114.33, 114.36, 114.37
See application file for complete search history.

(56) References Cited

U.S. PATENT DOCUMENTS

| | | | | |
|---|---|---|---|---|
| 6,298,816 | B1 * | 10/2001 | Marentette | F02M 35/10019 123/184.57 |
| 6,604,424 | B1 * | 8/2003 | Kawabe | G01L 19/0007 73/716 |
| 7,185,629 | B2 * | 3/2007 | Irihune | F02D 11/10 123/360 |
| 2002/0117136 | A1 * | 8/2002 | Wada | F02B 75/22 123/184.21 |
| 2004/0084016 | A1 * | 5/2004 | Torii | F02D 11/10 123/399 |
| 2008/0302173 | A1 * | 12/2008 | Saito | G01F 5/00 73/114.33 |
| 2009/0126670 | A1 * | 5/2009 | Kado | F02M 35/10137 123/184.21 |
| 2010/0006052 | A1 * | 1/2010 | Akiyama | F02D 9/106 123/184.56 |
| 2012/0240898 | A1 * | 9/2012 | Lemecha | F02D 9/105 123/350 |
| 2016/0319782 | A1 * | 11/2016 | Hutyan | F02M 35/10091 |

FOREIGN PATENT DOCUMENTS

| | | | |
|---|---|---|---|
| JP | 2007-239527 | A | 9/2007 |
| KR | 20-2010-0008780 | U | 9/2010 |
| KR | 101222821 | B1 | 1/2013 |

* cited by examiner

ELECTRONIC THROTTLE VALVE APPARATUS

CROSS-REFERENCE TO RELATED APPLICATION

This application claims the benefit of priority to Korean Patent Application No. 10-2018-0098347, filed on Aug. 23, 2018, the disclosure of which is incorporated herein by reference in its entirety.

TECHNICAL FIELD

Exemplary embodiments of the present disclosure relate to an electronic throttle valve apparatus, and more particularly to an electronic throttle valve apparatus including a suction pressure sensor provided on an upstream of a throttle valve to measure pressure of an intake air flowing into the throttle valve.

RELATED ART

A throttle valve is a valve for adjusting an amount of air supplied to a combustion chamber, and the open degree of the throttle valve is adjusted based on the degree of manipulation of an acceleration pedal.

In the related art, the throttle valve is connected to the acceleration pedal through a cable to mechanically control the open degree of the throttle valve, but an electronic throttle valve apparatus is recently used to control a motor connected to the throttle valve in response to signals received from an acceleration pedal sensor and a throttle sensor. The electronic throttle valve apparatus may precisely control the open degree of the throttle valve via measurement of the pressure of an intake air that flows into an engine using a suction pressure sensor provided between the electronic throttle valve apparatus and the engine.

In the related art, an intake air is supplied to an engine through a naturally aspirated system, and thus a separate sensor for measuring the pressure of the intake air is not provided on the upstream of the electronic throttle valve apparatus. Recently, for miniaturization and lightweight of the engine, gasoline direct injection (GDI) technology is being widely used, and a turbo device is mounted to compress and supply the intake air. A related technology is disclosed in Japanese Registered Patent No. 4416745.

In the case of mounting the turbo device as described above, the intake air is compressed and supplied by the turbo device, and thus it is necessary to measure the pressure of the intake air supplied to the throttle valve in order to precisely control the throttle valve.

SUMMARY

The present disclosure may overcome the above disadvantages and other disadvantages not described above, and it provides an electronic throttle valve apparatus effectively provided with a suction pressure sensor capable of measuring pressure of an intake air that flows into a throttle valve on a front end side of the throttle valve.

Other aspects and advantages of the present disclosure may be understood by the following description, and become apparent with reference to the exemplary embodiments of the present disclosure. Further, it is obvious to those skilled in the art to which the present disclosure pertains that the aspects and advantages of the present disclosure may be realized by the means as claimed and combinations thereof.

In accordance with one aspect of the present disclosure, an electronic throttle valve apparatus may include a throttle housing having one side installed in an intake manifold of an engine. Within an inside of the throttle housing, a throttle valve may be rotatably provided. The electronic throttle valve apparatus may further include an air tube fastened to the other side of the throttle housing and fastened to an intake flow line, and a suction pressure sensor provided in the air tube and configured to measure pressure of an intake air that flows through the intake flow line.

Specifically, the air tube may include a body portion provided in the form of a tube to allow the intake air to flow; a sensor fastening portion that protrudes from an outer periphery of the body portion in a radial direction, and having a communication aperture formed to communicate with an inside thereof to allow the intake air that passes through the body portion to flow therein, the suction pressure sensor inserted and fastened into the sensor fastening portion; a plurality of boss portions that protrude from one side of the body portion toward the throttle housing, and are radially formed to be fastened to the throttle housing; and a plurality of hook fastening portions radially provided to protrude from one side of the body portion toward an outer periphery of the throttle housing, and including hook grooves formed thereon to be fastened to the outer periphery of the throttle housing.

The body portion may further include a sensor fixing portion formed to fasten and fix the suction pressure sensor by a screw when the suction pressure sensor is inserted into the sensor fastening portion, and provided to allow the screw to be fastened as a female tap is formed during the screw fastening. The sensor fixing portion may be provided in the form of a slit along a circumferential direction of the sensor fastening portion, and may be formed to be fastened and fixed by the screw after rotating the suction pressure sensor to a desired direction. The sensor fastening portion may be provided to deploy the suction pressure sensor with a predetermined inclination with respect to a flow direction of the intake air that passes through the body portion. The air tube may further include a plurality of flange portions radially formed to extend from one side end of the body portion to an outside in the radial direction, wherein the boss portions are formed on the plurality of flange portions, respectively, and the hook fastening portions are formed on at least two of the plurality of flange portions.

The throttle housing may include a plurality of fastening grooves radially formed on the other side surface of the throttle housing to allow the plurality of boss portions formed on the air tube to be respectively inserted therein; and a plurality of hook projections radially formed on the outer periphery of the throttle housing to be respectively inserted and fastened into the plurality of hook grooves formed on the air tube. The boss portion may include a first boss portion and a second boss portion respectively formed in diagonal locations around a direction in which the intake air flows in the body portion, and three-point projections may be formed to project in the radial direction on outer peripheries of the first boss portion and the second boss portion. A location of the three-point projection formed on the first boss portion and a location of the three-point projection formed on the second boss portion may be different from each other with respect to circumferential directions thereof.

The boss portion may include a through-hole formed thereon to allow a screw to be penetratingly inserted into the through-hole to fasten the throttle housing to the intake manifold by the screw when the air tube is fastened to the throttle housing.

According to the electronic throttle valve apparatus according to the present disclosure, the suction pressure sensor is provided in the air tube that is fastened to the throttle housing, and thus the pressure of the intake air flowing into the throttle valve may be easily measured.

It is to be understood that the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
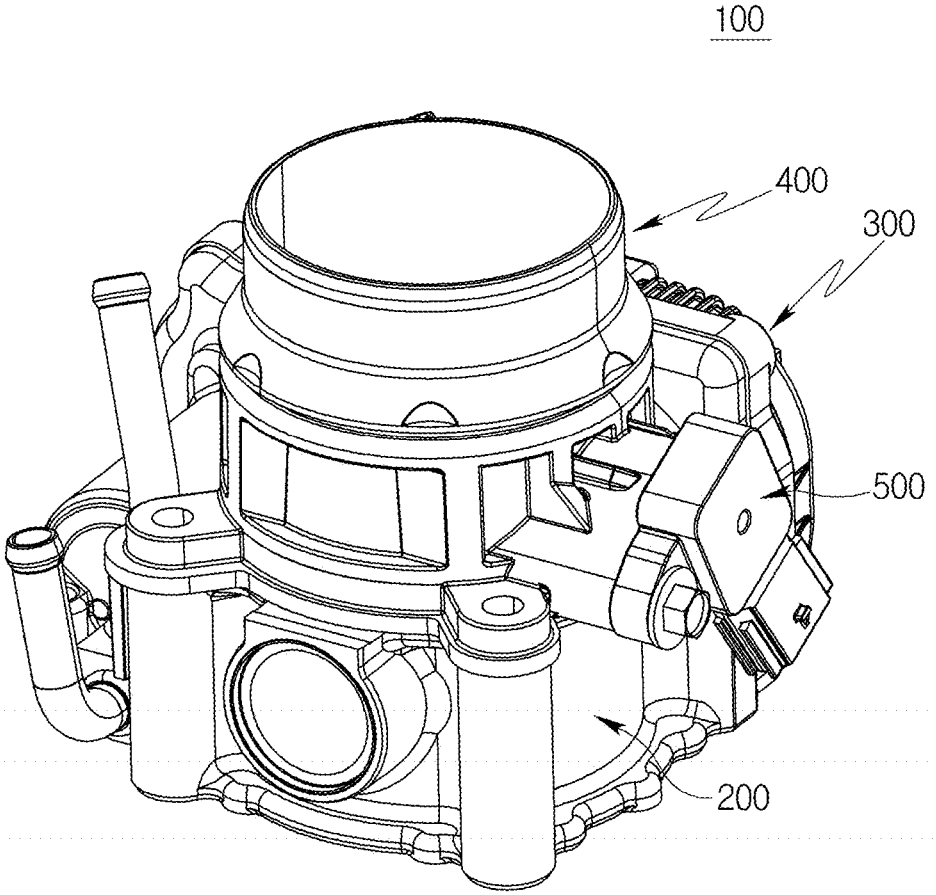
FIG. 1 is a perspective view schematically illustrating an electronic throttle valve apparatus according to an exemplary embodiment of the present disclosure.

Hereinafter, an electronic throttle valve apparatus related to exemplary embodiments of the present disclosure will be described to help understanding of features of the present disclosure. To help understanding of exemplary embodiments described hereinafter, it is to be noted that the same drawing reference numerals are used for the same elements across various figures. Further, in describing the present disclosure, detailed explanation of related known configurations or functions will be omitted when it may obscure the subject matter of the present disclosure in unnecessary detail.

Hereinafter, detailed exemplary embodiments of the present disclosure will be described with reference to the accompanying drawings.

Figure 2:
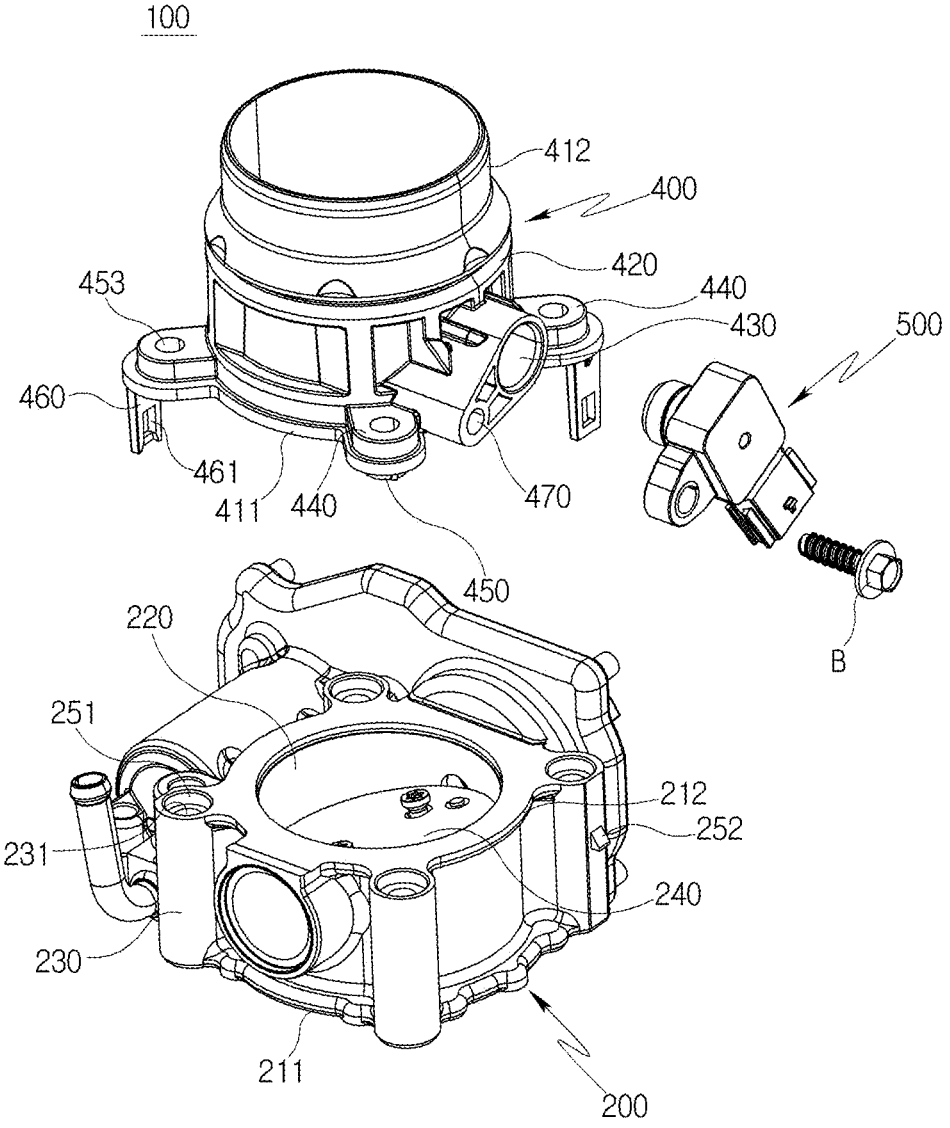
FIG. 2 is an exploded perspective view schematically illustrating an electronic throttle valve apparatus according to an exemplary embodiment of the present disclosure.
Figure 3:
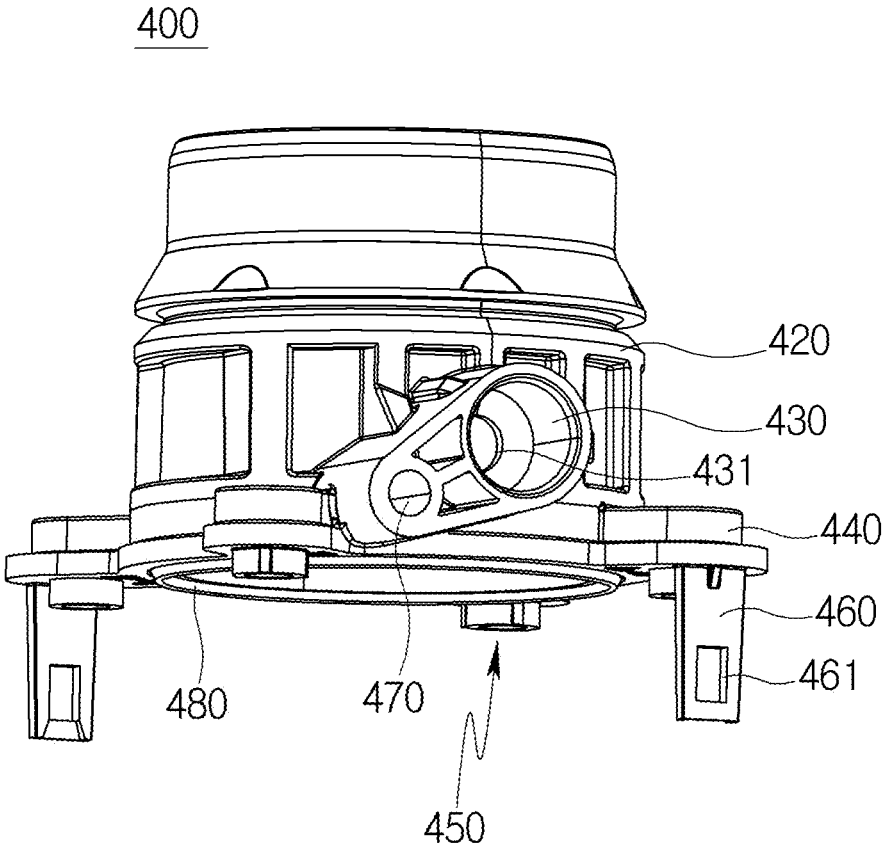
FIG. 3 is a perspective view schematically illustrating an air tube extracted from an electronic throttle valve apparatus according to an exemplary embodiment of the present disclosure.
Figure 4:
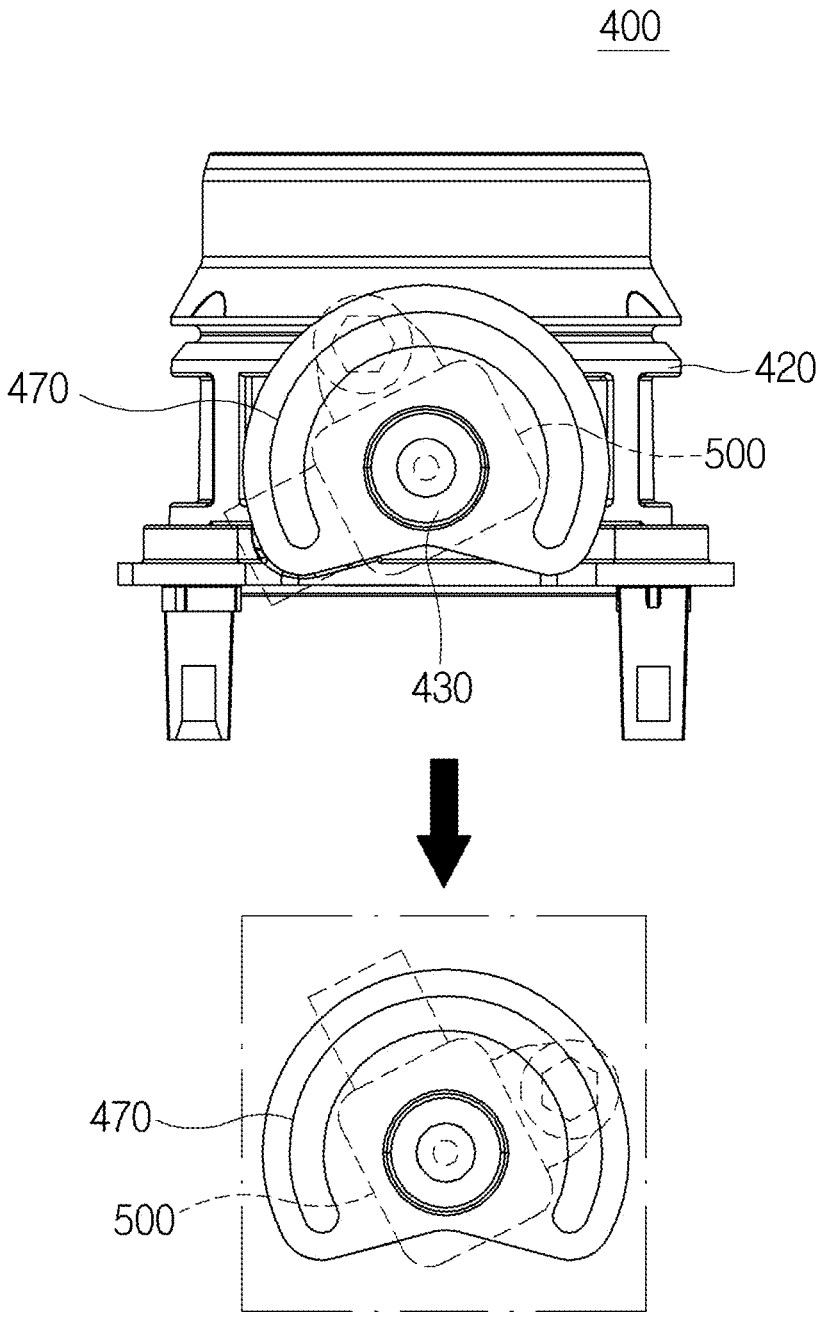
FIG. 4 is a side view schematically illustrating a sensor fixing portion in an air tube of an electronic throttle valve apparatus according to another exemplary embodiment of the present disclosure.

FIGS. 1 and 2 are a perspective view and an exploded perspective view schematically illustrating an electronic throttle valve apparatus according to an exemplary embodiment of the present disclosure. FIG. 3 is a perspective view schematically illustrating an air tube extracted from an electronic throttle valve apparatus according to an exemplary embodiment of the present disclosure, and FIG. 4 is a side view schematically illustrating a sensor fixing portion in an air tube of an electronic throttle valve apparatus according to another exemplary embodiment of the present disclosure.

Figure 5:
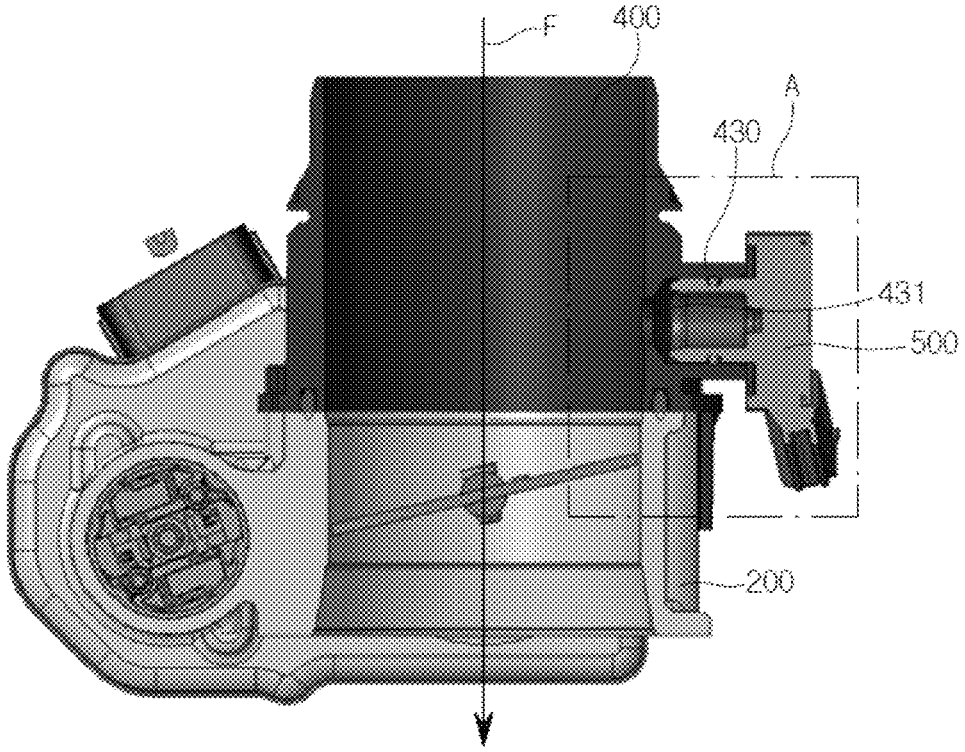
FIG. 5 is a cross-sectional view schematically illustrating an electronic throttle valve apparatus according to an exemplary embodiment of the present disclosure.
Figure 6A:
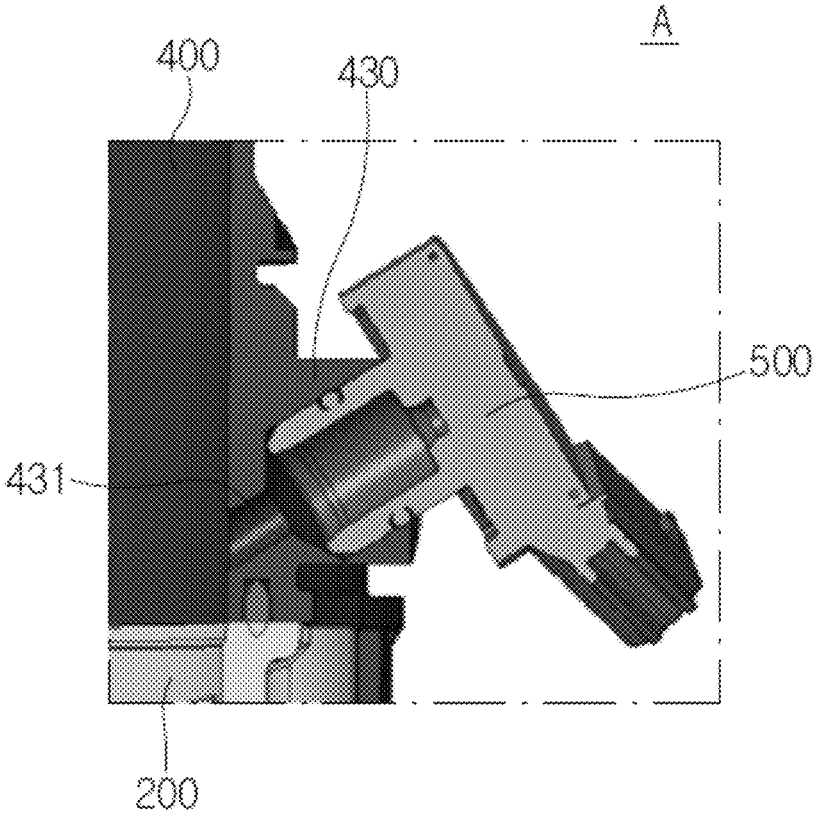
FIGS. 6A and 6B are cross-sectional views schematically illustrating a suction pressure sensor of an electronic throttle valve apparatus installed at different angles according to an exemplary embodiment of the present disclosure.
Figure 6B:
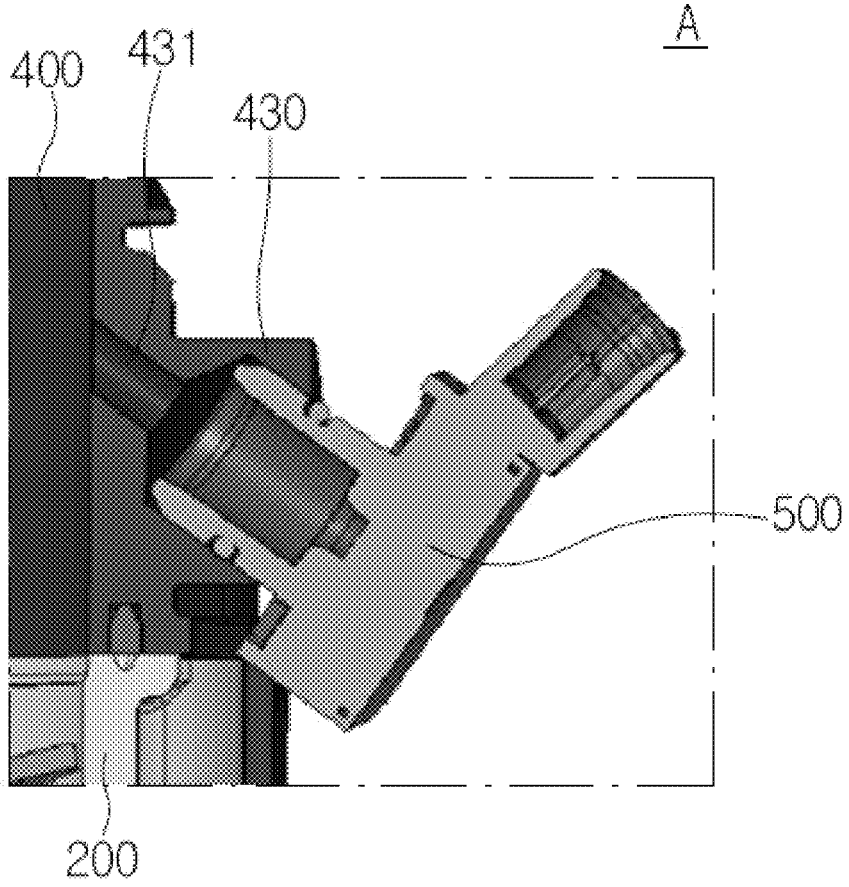
Figure 7A:
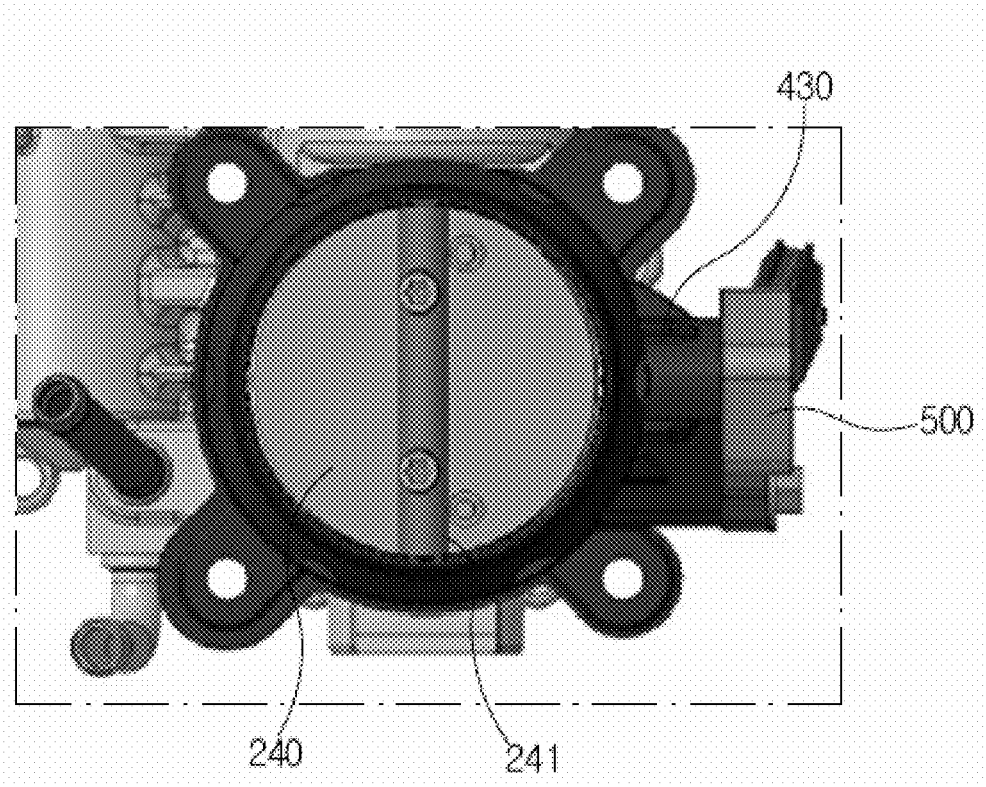
FIGS. 7A and 7B are plan views schematically illustrating a suction pressure sensor of an electronic throttle valve apparatus installed at different locations in an air tube according to an exemplary embodiment of the present disclosure.
Figure 7B:
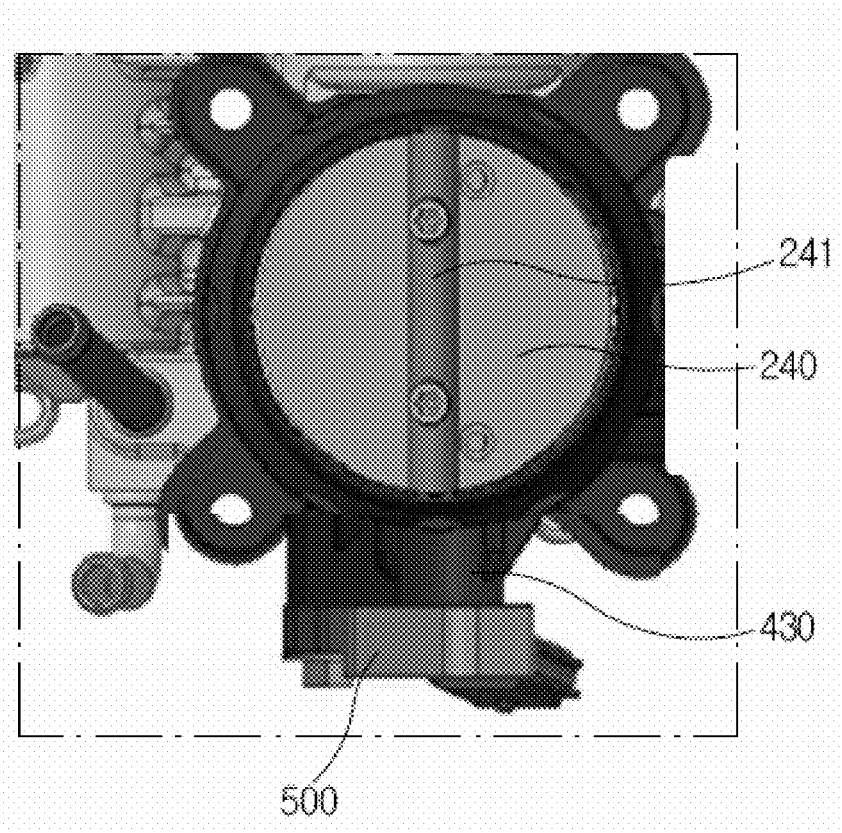

FIG. 5 is a cross-sectional view schematically illustrating an electronic throttle valve apparatus according to an exemplary embodiment of the present disclosure. FIGS. 6A and 6B are cross-sectional views schematically illustrating a suction pressure sensor of an electronic throttle valve apparatus installed at different angles according to an exemplary embodiment of the present disclosure, and FIGS. 7A and 7B are plan views schematically illustrating a suction pressure sensor of an electronic throttle valve apparatus installed at different locations in an air tube according to an exemplary embodiment of the present disclosure.

Figure 8:
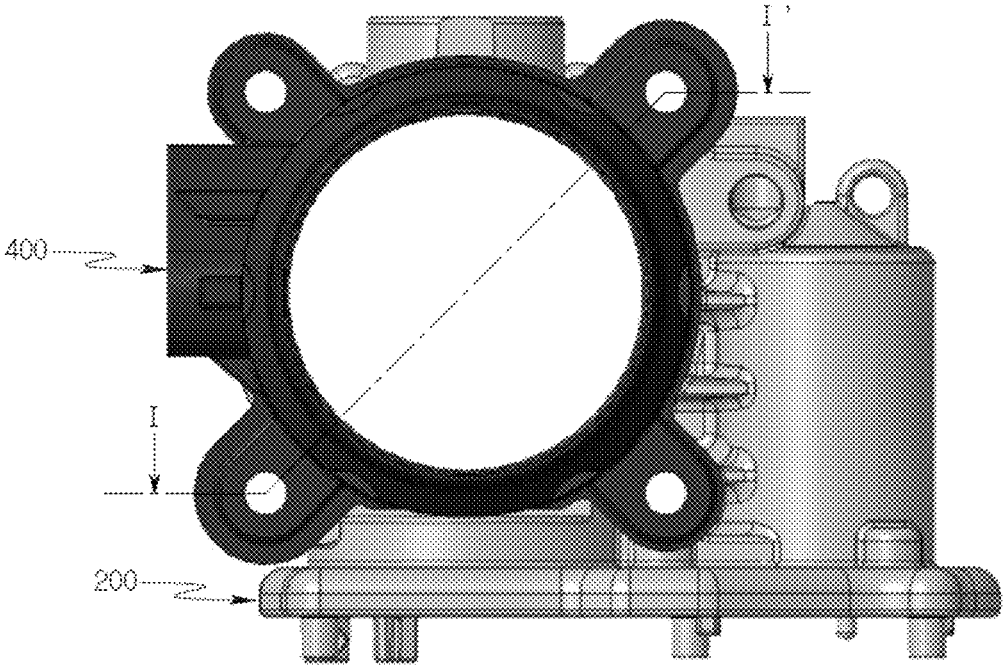
FIG. 8 is a plan view schematically illustrating an electronic throttle valve apparatus according to an exemplary embodiment of the present disclosure.
Figure 9:
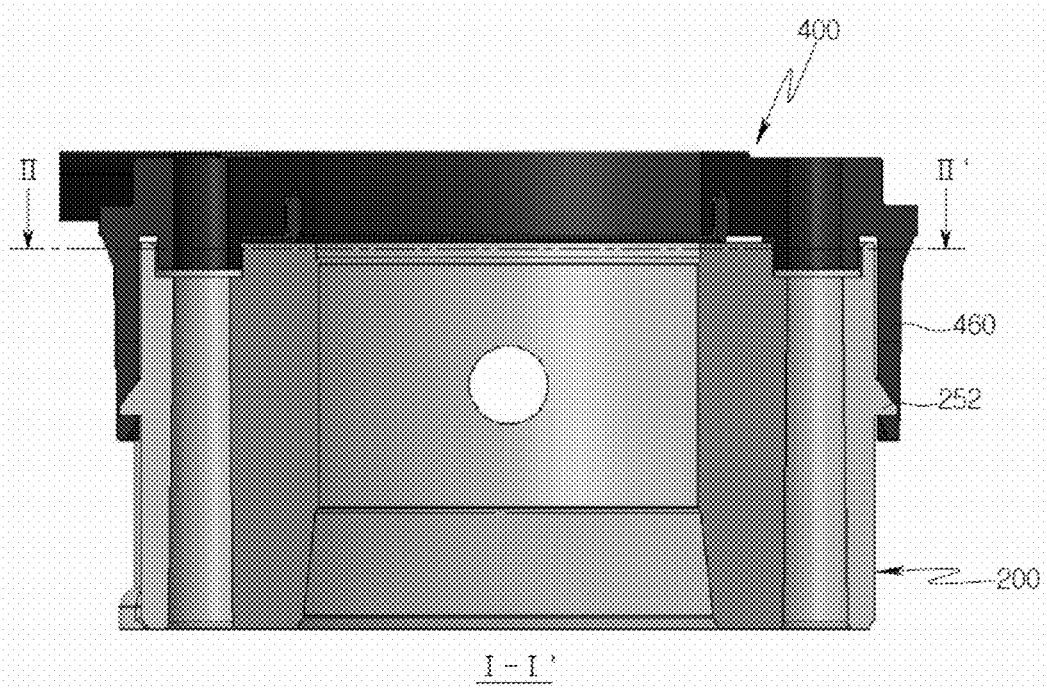
FIG. 9 is a schematic cross-sectional view taken along line I-I' of FIG. 8.
Figure 10:
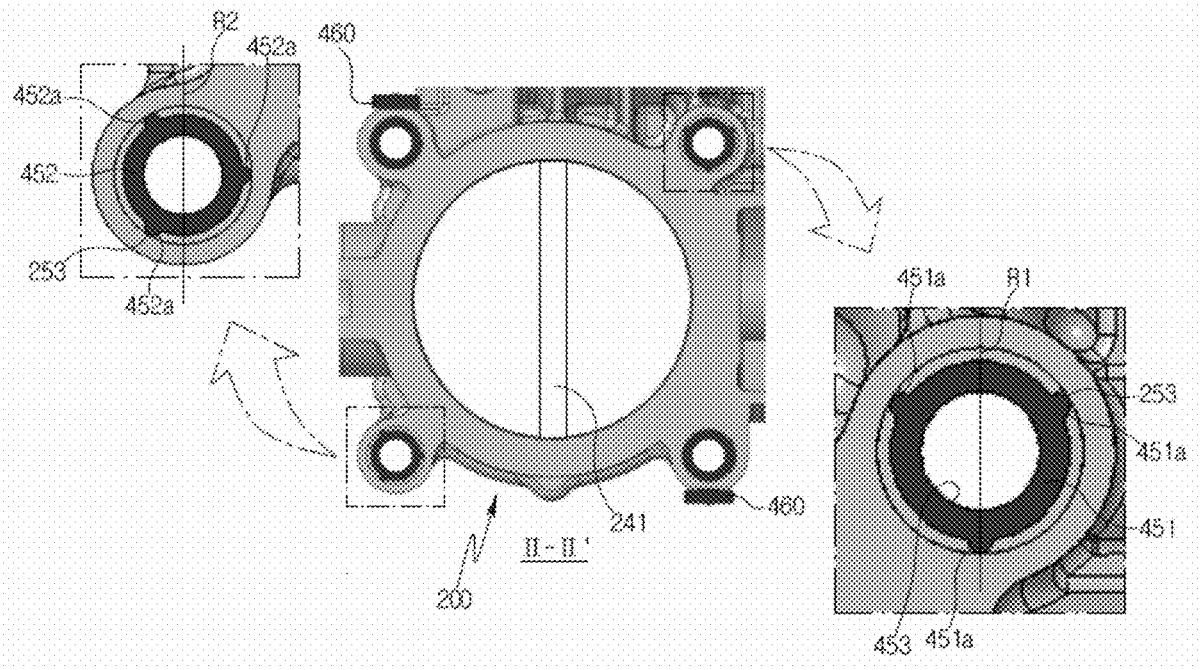
FIG. 10 is a schematic cross-sectional view taken along line II-II' of FIG. 9.

FIG. 8 is a plan view schematically illustrating an electronic throttle valve apparatus according to an exemplary embodiment of the present disclosure. FIG. 9 is a schematic cross-sectional view taken along line I-I' of FIG. 8, and FIG. 10 is a schematic cross-sectional view taken along line II-II' of FIG. 9.

With reference to FIGS. 1 to 10, an electronic throttle valve apparatus 100 according to an exemplary embodiment of the present disclosure may include a throttle housing 200 having one side 211 on which an intake manifold (not illustrated) of an engine is installed. Within an inside of the throttle housing 200, a throttle valve 240 may be rotatably provided. The electronic throttle valve apparatus 100 according to an exemplary embodiment of the present disclosure may further include an air tube 400 fastened to the other side 212 of the throttle housing 200 and fastened to an intake flow line (not illustrated), and a suction pressure sensor 500 provided in the air tube 400 and configured to measure pressure of an intake air that flows through the intake flow line. In particular, the suction pressure sensor 500 may be fastened to the air tube 400, and may measure the pressure of the intake air when the intake air that is compressed by a turbo device flows into the throttle housing 200. The suction pressure sensor 500 may be a general sensor that is widely used in the related art, and the detailed explanation thereof will be omitted.

In the throttle housing 200, a cylindrical bore 220 for intake air flow may be penetratingly formed at the center, and mounting bosses 230 for mounting the throttle housing 200 on the intake manifold may be formed at four positions on an outer periphery of the bore 220. A fastening aperture 231 may be formed in each mounting boss 230 to allow a bolt or a screw (not illustrated) to be inserted into the fastening hole 231.

Further, the throttle valve 240 may be rotatably fastened into the bore 220 of the throttle housing 200, and the throttle valve 240 may be provided to be rotated by a rotating power transferred via a gear box 300 provided on one side of the throttle housing 200 to open and close the bore 220.

Further, fastening grooves 251 and hook projections 252 may be formed on the throttle housing 200 to fasten the throttle housing 200 to the air tube 400. More specifically, a plurality of fastening grooves 251 may be radially formed on the other side 212 of the throttle housing 200 to allow a plurality of boss portions 450 formed on the air tube 400 to be respectively inserted into the plurality of fastening grooves 251. In other words, the fastening grooves 251 may be formed at end portions of the mounting bosses 230, and may have a greater diameter than the diameter of the fastening apertures 231. Further, a plurality of hook projections 252 may be radially formed to project from the outer periphery to allow the plurality of hook projections 252 to be respectively inserted and fastened into a plurality of hook grooves 461 formed on the air tube 400.

The throttle housing 200 as described above may be made of a metal material, such as aluminum or an aluminum alloy. One side 411 of the air tube 400 may be fastened to the other side 212 of the throttle housing 200, and the intake flow line may be fastened to the other side 412 of the air tube 400. In particular, the air tube 400 may include a body portion 420 provided in the form of a tube to allow the intake air to flow, a sensor fastening portion 430 to which the suction pressure sensor 500 is fastened, boss portions 450 fastened to the throttle housing 200, and hook fastening portions 460 fastened to hook projections 252 formed on the throttle housing 200. Further, the air tube 400 may further include an air tube sealing member 480 provided on the one side 411 to seal a contact surface between the air tube 400 and the throttle housing 200 to prevent the intake air from leaking to outside when the air tube 400 is fastened to the throttle housing 200.

More specifically, the body portion 420 may communicate with the bore 220 of the throttle housing 200, and may be provided in the form of a tube, the center of which is penetratingly formed to allow the intake air supplied from the intake flow line to flow to the bore 220 of the throttle housing 200. Further, the sensor fastening portion 430 may protrude from an outer periphery of the body portion 420 in a radial direction, and may include a communication aperture 431 formed to communicate with an inside thereof to allow the intake air that passes through the body portion 420 to flow into the suction pressure sensor 500. The suction pressure sensor 500 may be inserted and fastened into the sensor fastening portion 430.

Further, a plurality of boss portions 450 may protrude from one side of the body portion 420 toward the throttle housing 200, and the plurality of boss portions 450 may be radially formed to be inserted and fastened into the fastening grooves 251 formed on the mounting bosses 230 of the throttle housing 200. Further, a plurality of hook fastening portions 460 may be radially provided to protrude from one side of the body portion 420 toward the outer periphery of the throttle housing 200, and hook grooves 461 may be formed thereon to be fastened to the hook projections 252 formed on the outer periphery of the throttle housing 200.

As illustrated in FIG. 2, the body portion 420 may further include a sensor fixing portion 470 formed to fasten and fix the suction pressure sensor 500 via a screw B while the suction pressure sensor 500 is inserted into the sensor fastening portion 430, and provided to allow the screw B to be fastened as a female tap is formed during fastening of the screw B.

Further, as illustrated in FIG. 4, the sensor fixing portion 470 may be provided in the form of a slit that is formed along a circumferential direction, and the sensor fixing portion 470 may be formed to be fastened and fixed by the screw with the suction pressure sensor 500 rotated to a desired direction.

In other words, since arrangements of surrounding components to which the suction pressure sensor is fastened may vary based on vehicle models, the installation directions of the suction pressure sensor in order to avoid interference with other components may also vary based on the vehicle models. Accordingly, the sensor fixing portion may be formed in the form of a slit along the circumferential direction without limiting in advance the location of the sensor fixing portion, and then the sensor fixing portion may be fixed by fastening the screw after inserting the suction pressure sensor into the sensor fastening portion in a desired direction. Therefore, one air tube may be used in various vehicle models, and thus the manufacturing cost may be decreased.

Further, the sensor fastening portion 430 may be formed to deploy the suction pressure sensor 500 with a predetermined inclination with respect to a flow direction F of the intake air that passes through the body portion 420. In general, as illustrated in FIG. 5, the suction pressure sensor 500 may be deployed in a vertical direction to the flow direction F of the intake air, and in order for the suction pressure sensor to avoid the interference with surrounding components to which the suction pressure sensor is fastened, as illustrated in FIG. 6A, the sensor fastening portion 430 may be formed to deploy the suction pressure sensor 500 to be directed toward the throttle housing 200 with a predetermined inclination, or as illustrated in FIG. 6B, the sensor fastening portion 430 may be formed to deploy the suction pressure sensor 500 to be directed toward an inflow side of the air tube 400 with a predetermined inclination.

Further, as illustrated in FIG. 7A, the sensor fastening portion 430 may be formed in the vertical direction with respect to an axial direction of a rotating shaft 241 of the throttle valve 240, or as illustrated in FIG. 7B, the sensor fastening portion 430 may be formed in the direction that is in parallel with the axial direction of the rotating shaft 241 of the throttle valve 240. Accordingly, a suitable one of air tubes formed to allow the sensor fastening portion to have a different angle or a different installation location may be selected and used based on the vehicle models.

In addition, the air tube may further include a plurality of flange portions 440 radially formed to extend from one side end of the body portion 420 to an outside in the radial direction. In this case, the boss portions 450 may be formed on the plurality of flange portions 440, respectively, and the hook fastening portions 460 may be formed on at least two of the plurality of flange portions 440. Further, the boss portion 450 may include a first boss portion 451 and a second boss portion 452 respectively formed in diagonal locations around the direction in which the intake air flows in the body portion 420, and three-point projections 451*a* and 452*a* are formed to project in the radial direction on outer peripheries of the first boss portion 451 and the second boss portion 452.

Correspondingly, insertion grooves 253 may be formed on the fastening grooves 251 to allow the three-point projections 451*a* and 452*a* to be inserted into respective locations in which the first boss portion 451 and the second boss portion 452 are inserted. In other words, in the case where the first boss portion 451 and the second boss portion 452 are inserted into the fastening grooves 251, the three-point projection 451*a* formed on the first boss portion 451 and the three-point projection 452*a* formed on the second boss portion 452 may be fixedly inserted into the insertion grooves 253 formed on the fastening grooves 251.

In particular, as illustrated in FIG. 10, a location of the three-point projection 451*a* formed on the first boss portion 451 and a location of the three-point projection 452*a* formed on the second boss portion 452 may be different from each other with respect to the circumferential directions thereof. In other words, in accordance with the circumferential direction around a first reference line R1 that is parallel to the rotating shaft 241 of the throttle valve 240 and a second reference line R2, the location of the three-point projection 451*a* formed on the first boss portion 451 may be different from the location of the three-point projection 452*a* formed on the second boss portion 452. Accordingly, the air tube 400 may be prevented from shaking in right and left directions and in the rotating direction when the air tube 400 is fastened to the throttle housing 200.

In such a configuration, with reference to FIG. 10, four flange portions 440 may be radially formed on the air tube 400, and the boss portions 450 may be formed on the four flange portions 440, respectively. Among the boss portions 450, the three-point projections 451*a* and 452*a* may be formed on the first boss portion 451 and the second boss portion 452 that diagonally face each other, and the hook fastening portions 460 may be provided on the two remaining boss portions on which the three-point projections are not formed.

Further, the through-hole 453, into which the screw is penetratingly inserted, may be formed on the boss portion 450 to allow the air tube 400 to be fastened to the intake manifold by the screw when the air tube 400 is fastened to the throttle housing 200. In other words, the air tube 400 may be assembled with the throttle housing 200 by hook fastening through the hook fastening portions 460 to be deployed in the intake manifold in an assembled state, and then the screw may be inserted into the through-hole 453 to fasten the air tube 400 to the intake manifold after the screw penetrates the mounting boss 230 of the throttle housing 200.

As described above, since several complicated configurations, such as the sensor fastening portions 430, may be formed on the air tube 400, it is preferable that the air tube is made of plastic to increase the degree of design freedom.

Although exemplary embodiments of the present disclosure have been described for illustrative purposes, the present disclosure is not limited thereto, and those of ordinary skill in the art will appreciate that various modifications, additions and substitutions are possible, without departing from the scope and spirit of the disclosure as disclosed in the accompanying claims.

What is claimed is:

1. An electronic throttle valve apparatus comprising:

a throttle housing having one side installed in an intake manifold of an engine;

a throttle valve rotatably provided within the throttle housing;

an air tube fastened to the other side of the throttle housing and fastened to an intake flow line; and a suction pressure sensor provided in the air tube and configured to measure pressure of an intake air that flows through the intake flow line, wherein the air tube comprises:

a body portion provided in the form of a tube to allow the intake air to flow;

a sensor fastening portion that protrudes from an outer periphery of the body portion in a radial direction, and includes a communication aperture formed to communicate with an inside thereof to allow the intake air that passes through the body portion to flow therein, the suction pressure sensor being inserted and fastened into the sensor fastening portion; and a plurality of boss portions that protrudes from one side of the body portion toward the throttle housing, and are radially formed to be fastened to the throttle housing;

wherein the boss portion comprises a first hoes portion and a second boss portion respectively formed in diagonal locations around a direction in which the intake air flows in the body portion, and three-point projections are formed to project in the radial direction on outer peripheries of the first boss portion and the second boss portion; and wherein a location of the three-point projection formed on the first boss portion and a location of the three-point projection formed on the second boss portion are different from each other with respect to circumferential directions thereof.

2. The electronic throttle valve apparatus of claim 1, wherein the air tube comprises:

a plurality of hook fastening portions provided to radially protrude from one side of the body portion toward an outer periphery of the throttle housing, and including hook grooves formed thereon to be fastened to the outer periphery of the throttle housing.

3. The electronic throttle valve apparatus of claim 2, wherein the body portion further comprises a sensor fixing portion formed to fasten and fix the suction pressure sensor by a screw when the suction pressure sensor is inserted into the sensor fastening portion, and wherein the sensor fixing portion is provided to allow the screw to be fastened as a female tap is formed during the screw fastening.

4. The electronic throttle valve apparatus of claim 3, wherein the sensor fixing portion is provided in the form of a slit along a circumferential direction of the sensor fastening portion, and is formed to be fastened and fixed by the screw with the suction pressure sensor rotated to a desired direction.

5. The electronic throttle valve apparatus of claim 2, wherein the sensor fastening portion is provided to deploy the suction pressure sensor with a predetermined inclination with respect to a flow direction of the intake air that passes through the body portion.

6. The electronic throttle valve apparatus of claim 2, wherein the air tube further comprises a plurality of flange portions radially formed to extend from one side end of the body portion to an outside in the radial direction, and wherein the hook fastening portions are formed on at least two of the plurality of flange portions.

7. The electronic throttle valve apparatus of claim 2, wherein the throttle housing comprises:

a plurality of hook projections radially formed on the outer periphery of the throttle housing to be respectively inserted and fastened into the plurality of hook grooves formed on the air tube.

8. The electronic throttle valve apparatus of claim 2, wherein the boss portion includes a through-hole formed thereon to allow a screw to be penetratingly inserted into the through-hole to fasten the throttle housing to the intake manifold by the screw when the air tube is fastened to the throttle housing.

* * * * *